United States Patent [19]

Lewis et al.

[11] Patent Number: 4,824,141

[45] Date of Patent: Apr. 25, 1989

[54] PAGE HOLDER FOR BOOKS

[76] Inventors: Arthur M. Lewis; Flora B. Lewis, both of 157 Shelter Rock Rd. #36, Danbury, Conn. 06810

[21] Appl. No.: 34,915

[22] Filed: Apr. 6, 1987

[51] Int. Cl.[4] ..... B42D 9/00; B41J 11/00; A44B 19/00

[52] U.S. Cl. ..... 281/42; 40/352; 24/545

[58] Field of Search ..... 281/42, 45, 47, 48; 24/DIG. 9, 545; D19/91; 116/237–239; 40/352

[56] References Cited

U.S. PATENT DOCUMENTS

| | | | |
|---|---|---|---|
| 64,698 | 5/1867 | Patterson | 24/545 |
| 395,473 | 1/1889 | Bartley | 281/42 |
| 565,818 | 8/1896 | Ward | 281/42 |
| 1,229,516 | 6/1917 | Pierce | 281/42 |
| 1,821,427 | 9/1931 | Elder | 281/42 |
| 1,933,747 | 11/1933 | Minera | 281/42 |
| 2,606,042 | 8/1949 | Freber | 281/42 |
| 3,604,727 | 9/1971 | Wilkin | 281/42 |
| 3,701,332 | 10/1972 | Brooks | 281/42 |
| 4,382,617 | 5/1983 | Fortier | 281/42 |

*Primary Examiner*—Douglas D. Watts
*Assistant Examiner*—Paul M. Heyrana, Sr.
*Attorney, Agent, or Firm*—St.Onge Steward Johnston & Reens

[57] ABSTRACT

A compact page holder device 2 for holding a book 80 open at some selected pages 92, 94. A bundle of book leaves 96 including one of the selected pages 92 extends forward through slot 54, over finger 20, back through slot 52, and under finger 10. A second bundle of book leaves 98 including the other selected page 94 is woven forward through slot 54, over finger 30, back through slot 56, and under finger 40. The interweaving of page holder fingers and book leaf bundles keeps the book and the page holder securely together despite casual handling. Pages may be turned while the page holder is holding the book open by slipping the pages out from under one end finger 10 and back under the other end finger 40.

6 Claims, 3 Drawing Sheets

Fig. 3
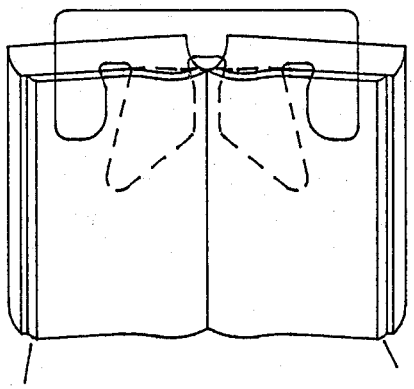
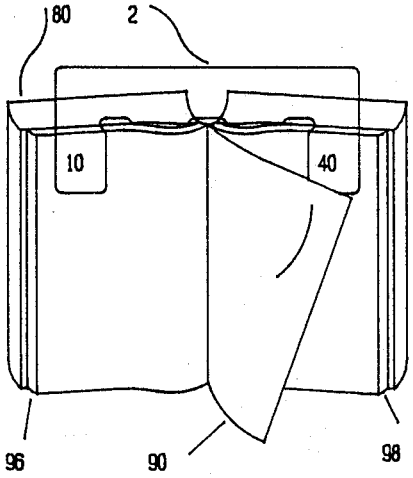
Fig. 4A
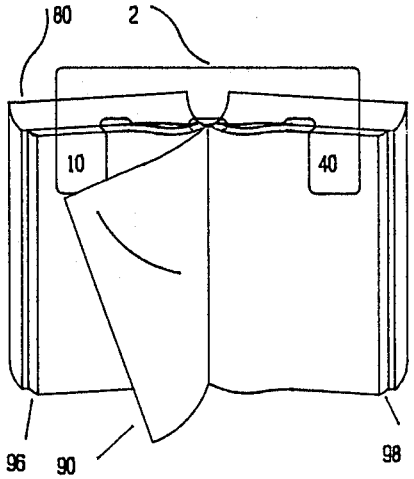
Fig. 4B
Fig. 5
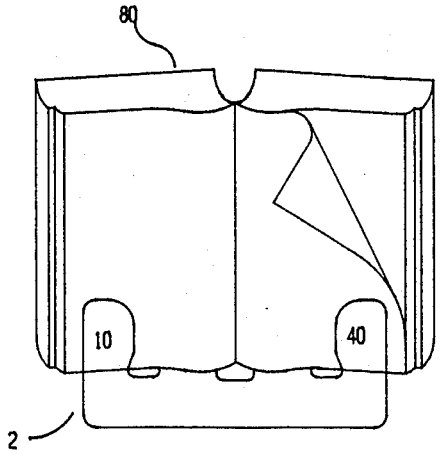

PAGE HOLDER FOR BOOKS

BACKGROUND—FIELD OF INVENTION

This page holder invention keeps a book open at any selected pages and remains firmly in place while allowing the user to hold the book and to turn pages.

BACKGROUND—DISCUSSION OF PRIOR ART

Several earlier devices for holding a book open to some selected pages have been small enough to be portable and to be usable without a tabletop or other convenient support for the book holder to rest upon. Three examples of such small portable devices are shown in U.S. Pat. Nos. 2,606,042, 3,604,727, and 4,382,617.

The wireform device of U.S. Pat. No. 4,382,617 generally requires two hands to turn pages while the device is in place on a book.

The illustrations of U.S. Pat. No. 3,604,727 show that invention in use with a separate book stand. This device may perform satisfactorily while the book rests undistrubed on a stationary surface. It tends to slide out of place however if the book is moved about and therefore does not work well when the book is held in the hand.

U.S. Pat. No. 2,606,042, shows a device made by cutting and bending a sheet of rigid material. It is somewhat more expensive to fabricate than the invention disclosured here.

OBJECTS AND ADVANTAGES

While reading a book held by hand, it is usually most comfortable to use both hands to hold the book open to the desired pages. An object of the present invention is to hold a book open without obscuring the text so that the reader can comfortably and easily hold the book with one hand.

Sometimes one wants to read a book without holding it at all. This desire is usually frustrated by the failure of a conventionally bound hard cover or paperback book to remain open at the selected pages. Even when the back of a book is "broken" the book will generally not stay open at most pages. Another object of this invention is to hold a book open to some desired pages while the book rests upon a table or other support.

This invention has the advantage that the pages of a book can be turned easily even while the book is held open by the page holder. Pages may be turned with one hand while the book rests on a support.

An additional advantage of this invention is its simple construction. It consists entirely of a single flat piece of stiff transparent material.

DESCRIPTION OF DRAWINGS

FIG. 3 shows the invention in place on a book.

FIGS. 4A and 4B illustrate how pages can be turned.

FIG. 5 shows an alternative installation.

LIST OF REFERENCE NUMERALS

Figure 1:
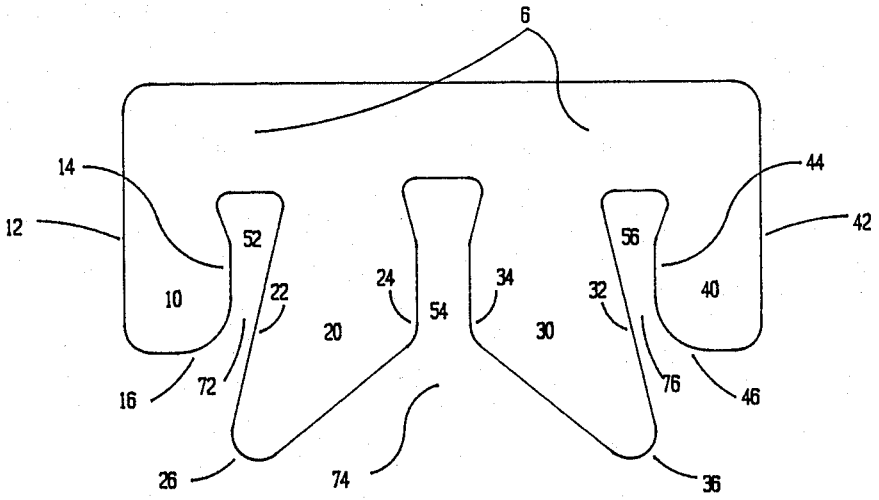
FIG. 1 shows a preferred embodiment of the invention.

2: page holder
6: base
10, 40: end fingers
20, 30: central fingers
12, 14 edges of 10
16, 46: inner corners of 10, 40
22, 24, 32, 34: edges of central fingers 20, 30
26, 36: tips of central fingers 20, 30
42, 44: edges of 40
52, 56: end slots
54: central slot
72, 76: pinched regions of end slots
74: flared opening of central slot
80: book
90: a page
92, 94: desired open pages
96, 97, 98: bundles of pages

DESCRIPTION OF INVENTION

Referring to FIG. 1, the present invention consists of a flat stiff sheet of clear material in the shape of four broad fingers 10, 20, 30, 40 extending to one side of a common base section 6, roughly like a coarse comb with oddly shaped teeth. A central slot 54 is defined by edges 24, 34 of central fingers 20 and 30. The central slot 54 flares widely at its open end 74 as the central fingers 20, 30 taper outward to small curved tips 26, 36. An end slot 52 lies between end finger 10 and central finger 20. Another end slot 56 lies between end finger 30 and central finger 40. The finger pairs 10, 20 and 30, 40 approach each other towards their outer ends so that slots 52 and 56 have pinched regions 72, 76 towards the open ends of those slots.

Figure 2:
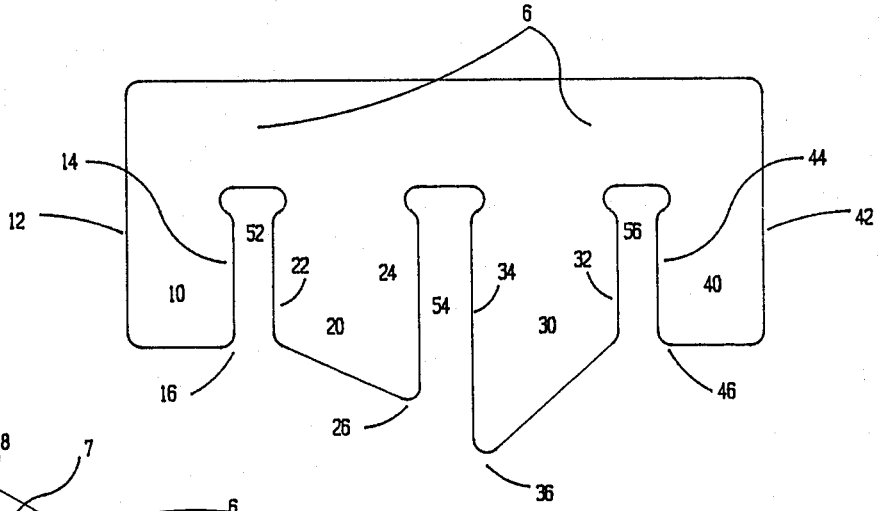
FIG. 2 shows another preferred embodiment of the invention.

FIG. 2 shows another embodiment of the invention in which the slots 52, 54, and 56 are straight. The central slot 54 is straight and longer than the end slots 52 and 56. The ends of the central fingers 20 and 30 taper to curved tips 26 and 36.

Practical embodiments of the invention may be cut from stiff sheets of transparent materials. Clear polycarbonate and rigid polyvinyl chloride are both satisfactory. Other clear rigid materials may also used. Thicknesses in the range of 0.010" to 0.10" may be used. The thickness should be chosen so the device is rigid enough to resist the self-closing forces of a book. It is also desireable that the sheet be thin so the page holder may be stored between the pages of a closed book.

A practical embodiment of the page holder may be cut from a sheet about 0.040" thick with a base section about 6 inches long and 1 inch wide. The end slots may be about ¼" wide. The central slot may be about ⅜" wide. The end fingers may extend about 1½ from the base. The central fingers may extend about 1" farther. This overall size permits the page holder to be can conveniently stored as a book mark between the pages of a typical soft cover pocket paperback book. These dimensions also work well with books ranging in size from pocket paperback books to large text books. Both larger and smaller versions can also be useful.

OPERATION OF INVENTION

FIG. 3 shows the page holder 2 in place across the top of a book 80. The book and page holder engage in a manner which keeps them mutually engaged. Two bundles of pages 96 and 98, each behind one of the selected open pages 92 and 94, come forward through the central slot 54 of the page holder 2. The passage of bundles through the central slot 54 keeps the page holder centered on the book, yet thin enough to be sufficiently ductile to withstand deformation with use as more particularly described in the next section, and to be sufficiently elastic to return to its flat shape on storage. One bundle 96 passes over central finger 20 and back through an end slot 52 and under end finger 10. The other bundle 98 passes over central finger 30 and back through an end slot 54 and under end finger 40. The weaving of the bundles 96, 98 over central fingers 20, 30 keeps the page holder in place. The placement of the bundles behind end fingers 10, 40 holds the bundles in place with the selected pages 92, 94 exposed. The narrow openings 72, 76 of the end slots 52, 56 provide a pinching action which gently grips the bundles.

Figure 8A:
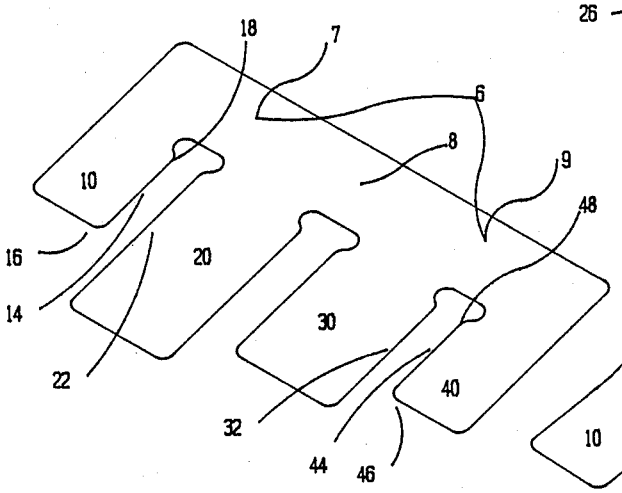
FIGS. 8A and 8B compare the natural shape of the invention and a typical bent shape it assumes when in use on a book.
Figure 8B:
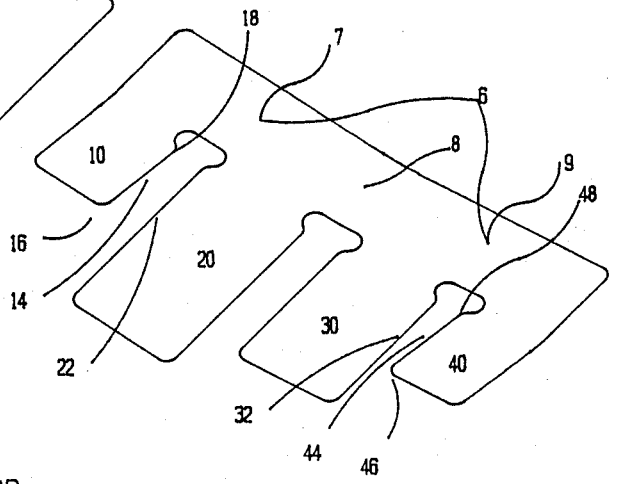

A bundle of pages 96 is woven in front of inner fingers 20 and behind outer fingers 10. The bundle may be about 1/16" to ⅛" thick. Such a bundle presses at inner end 16 of edge 14 of outer finger 10, bending base 6 and thereby bending the finger towards the reader and lifts corner 16 of finger 10 away from bundle 96. Similarly the bundle of pages 98 lifts the free end of finger 40 away from bundle 98. FIG. 8B shows a bent shape typically assumed by the invention while installed on a book.

Because of the page holder's bent shape, the inner corners 16, 46 of outer fingers 10, 40 do not lie tightly against the underlying open pages 92, 94. The curved shape at corners 16, 46 of outer fingers further helps to create small gaps between these corners and the underlying open pages 92, 94 which make it easy to slip pages under these corners as shown in FIG. 4B. This may readily be accomplished with one hand. Turning the pages in this manner only slightly disturbs the page holder on the book as one side or the other grips its bundle of pages securely even while the other side is being disturbed.

When a bundle of pages 96 is very loose or very thin, the open page 92 may lie behind corner 16 with no gap. Even under this condition it is still easy to slip a page under corner 16 as the pressure of the corner against the page is low when the bundles is thin or loose.

In FIG. 5, the page holder 2 is shown installed across the bottom of a book 80. This arrangement may be convenient when the book is resting on a table or other stationary support rather than being held in the hand. This bottom installation permits the reader to peek ahead at succeeding pages.

The forces which the book and the page holder exert upon each other hold the page holder firmly in place. Casual handling or movement of the combination does not dislodge the page holder.

Figure 6:
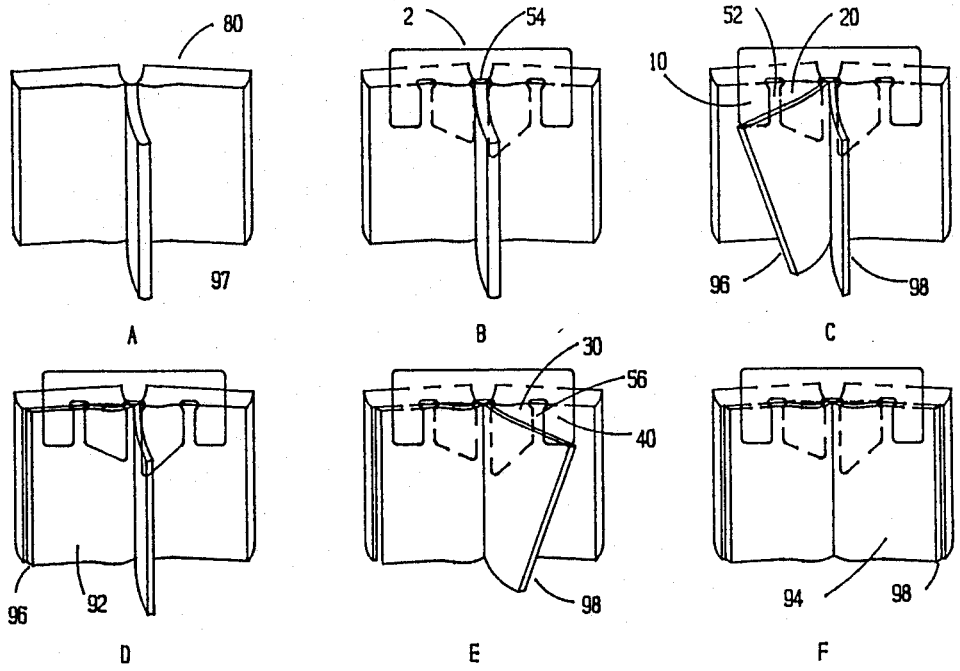
FIGS. 6A through 6F show a method for installing the page holder on a book.

A method for installing the page holder on a book is shown in FIG. 6:

FIG. 6A: A bundle of pages 97 including the desired pages is raised from the open book 80.

FIG. 6B: The page holder 2 is placed over the remaining pages with the bundle 97 protruding through the central slot 54.

FIG. 6C: Bundle 97 is split into two bundles 96, 98. Bundle 96 is inserted into end slot 52 and behind finger 10.

FIG. 6D: Bundle 96 is seated in place with selected page 92 showing.

FIG. 6E: Bundle 98 is inserted into slot 54 and behind end finger 40.

FIG. 6F: Bundle 98 is seated with page 94 showing. Pages may then be turned as in FIG. 4 to the desired pages.

Figure 7:
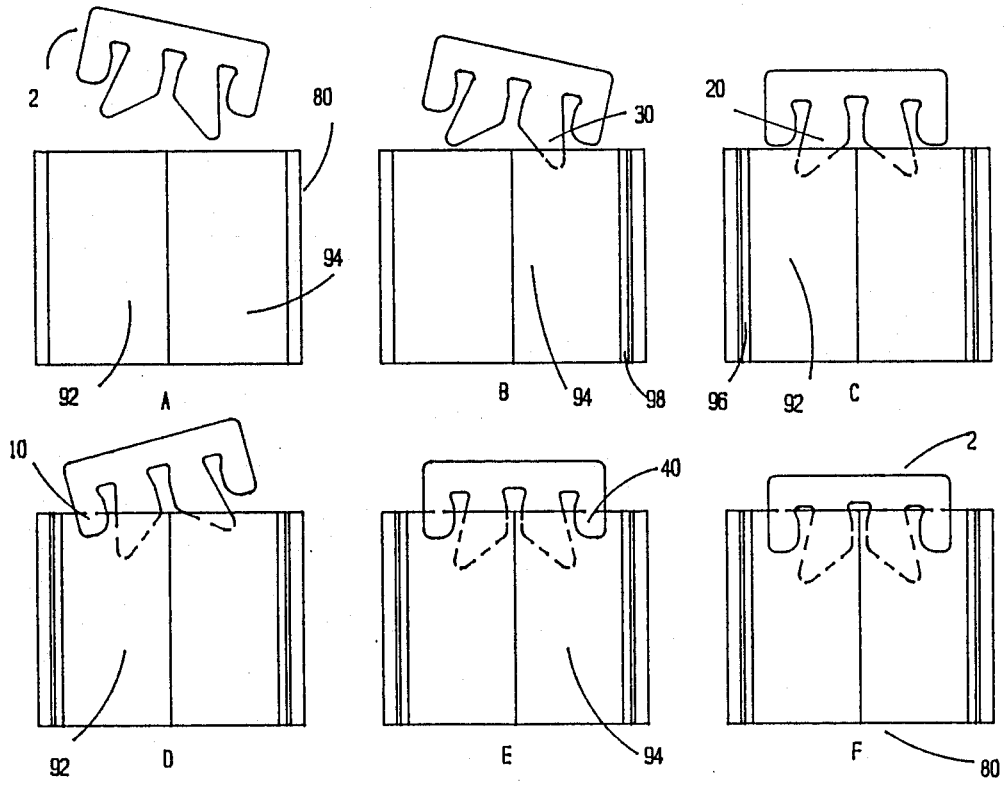
FIGS. 7A through 7F show an alternative installation method.

An alternative method of installation is shown in FIG. 7. The flared opening of the central slot facilitates this method of installation.

FIG. 7A: The book 80 is opened to the selected pages.

FIG. 7B: The tip of central finger 30 is inserted at the top of the book raising a bundle 98 of several pages including the open page 94.

FIG. 7C: The tip of the other central finger 20 is similarly inserted raising a bundle 96 of several pages including the other open page 92 raising a bundle 96.

FIG. 7D: The page holder is pushed further into the book 80 and turned while end finger 10 is bent forward to pass in front of the open page 92.

FIG. 7E: The page holder is pushed still further and turned while the other end finger 40 is bent forward to pass in front of open page 94.

FIG. 7F: The page holder 2 is pushed in further to fully engage the two bundles.

SCOPE OF INVENTION

While the description above contains many specificities, the dimensions, shapes, and methods of fabrication can be changed substantially from those specifically described above and still yield a usable and useful embodiment of this invention. Accordingly the reader is requested to determine the scope of the invention by the appended claims and their legal equivalents, and not by the examples which have been given.

We claim:

1. A page holder for holding a book open to desired pages, said page holder comprising a transparent generally flat sheet sufficiently rigid to resist self-closing forces of said book, said sheet comprising four fingers extending to one side of a common base, the tips of the two central fingers being farther from said base than the tip of the end fingers, said page holder being dispose across the top or bottom of said book with each of said central fingers inserted behind a plurality of leaves behind each of said desired pages, and with each of said end fingers disposed in front of one of said desired pages, wherein an edge of each said end fingers and the proximal edge of the nearest of said central fingers define an end slot whose narrowest point is away from said base.

2. A page holder as in claim 1 wherein said central fingers taper to define a flared central slot.

3. A page holder as in claim 1 wherein said two central fingers are longer than said two end fingers.

4. A page holder used in combination with a book for holding said book open to selected pages, said page holder comprising a transparent flat rigid sheet comprising four fingers extending to one side of a common base, said four fingers defining three open slots between them, each slot having a base end and an open end, said page holder and said book being arranged with two bundles of leaves of said book, each of said bundles including one of the selected pages, each of said bundles extending, forward between the two central fingers of said four fingers, over an adjacent central finger, back through an end slot, and under an end finger, wherein the narrowest regions of said end slots of said three slots are near the open ends of said slots.

5. A page holder as in claim 4 wherein the central slot of said three slots flares wider away from said base.

6. A page holder as in claim 4 wherein the end fingers of said four fingers are shorter than the central fingers of said four fingers.

* * * * *